US005090403A

United States Patent [19]

Bucher

[11] Patent Number: 5,090,403

[45] Date of Patent: Feb. 25, 1992

[54] AIR BUBBLE MAT FOR AIR BUBBLE MASSAGE DEVICE

[75] Inventor: Heinz Bucher, Rottweil, Fed. Rep. of Germany

[73] Assignee: Metronic Electronic GmbH, Fed. Rep. of Germany

[21] Appl. No.: 585,938

[22] Filed: Sep. 20, 1990

[30] Foreign Application Priority Data

Sep. 21, 1989 [DE] Fed. Rep. of Germany ..... 3931489

[51] Int. Cl.[5] ..... A61H 9/00

[52] U.S. Cl. ..... 128/66; 4/542; 4/543

[58] Field of Search ..... 128/65, 66; 4/542, 543

[56] References Cited

U.S. PATENT DOCUMENTS

| | | | |
|---|---|---|---|
| 1,982,259 | 11/1934 | Martin | 4/542 |
| 4,290,982 | 9/1981 | Baumann | 4/542 X |
| 4,409,693 | 10/1983 | Baumann | 4/543 |
| 4,984,583 | 1/1991 | Peterson et al. | 128/66 |

FOREIGN PATENT DOCUMENTS

| | | |
|---|---|---|
| 1801813 | 12/1959 | Fed. Rep. of Germany . |
| 214064 | 3/1961 | Fed. Rep. of Germany . |
| 6750493 | 1/1969 | Fed. Rep. of Germany . |
| 6604416 | 1/1970 | Fed. Rep. of Germany . |
| 7332469 | 5/1974 | Fed. Rep. of Germany . |
| 7815777 | 3/1979 | Fed. Rep. of Germany . |
| 3305576 | 2/1984 | Fed. Rep. of Germany . |
| 3248842 | 4/1984 | Fed. Rep. of Germany . |
| 3538673 | 5/1987 | Fed. Rep. of Germany . |
| 1352270 | 1/1964 | France . |
| 646864 | 12/1984 | Switzerland . |

*Primary Examiner*—Robert A. Hafer
*Assistant Examiner*—Brian E. Hanlon
*Attorney, Agent, or Firm*—Speckman & Pauley

[57] ABSTRACT

The invention relates to an air bubble mat for an air bubble massage device having a single mat section extending over its entire length and width and provided with openings, or having a plurality of individual mat sections extending over its width and provided with openings, which mat sections are lined up in the longitudinal direction of the air bubble mat, where the single mat section or the individual mat sections form a receptacle on their underside for receiving air feed ducts or air chambers, which air feed ducts are provided with air outlets corresponding to openings of the mat sections and are connected to a connecting stub or to a compressed air distributor with a connecting stub. Construction with uncomplicated parts and the simplest assembly possible are attained where the single mat section or the individual mat sections merely provide a support element, which has in its receptacle a one-piece or multi-piece foil mat, where the sections of the foil mat are each put together from two foils placed on top of one another, between which the air feed ducts or air chambers have been defined by welding or other connections outside of the air feed ducts or air chambers, where the air feed ducts or air chambers of the sections of the foil mat are connected with each other and/or with the connecting stub and where the air outlets are inserted in the foils of the section of the foil mat facing the underside of the support element.

23 Claims, 2 Drawing Sheets

AIR BUBBLE MAT FOR AIR BUBBLE MASSAGE DEVICE

BACKGROUND OF THE INVENTION

1. Field of the Invention

The invention relates to an air bubble mat for an air bubble massage device having a single mat section extending over its entire length and width and provided with openings, or having a plurality of individual mat sections extending over its width and provided with openings, which individual mat sections are lined up in the longitudinal direction of the air bubble mat, where the single mat section or the individual mat sections form a receptacle on their underside for receiving air feed ducts or air chambers, which are provided with air outlets in the area of the openings of the mat sections and are connected with a connecting stub or to a compressed air distributor with a connecting stub.

2. Description of Prior Art

An air bubble mat of this type is known from German Utility Model DE-GM 18 01 813. In this case the air feed ducts are in the form of hose sections which are brought into appropriate receptacles on the underside of the mat sections and extend over the entire length of the air bubble mat. The bubble pattern is limited to the longitudinally directed rows of air outlets. The individual air feed ducts can be controlled and provided with compressed air individually or in combination by means of a compressed air distributor connected to one end of the air bubble mat, which compressed air is supplied by a blower through a air hose which is inserted into the connecting stub of the compressed air distributor.

The mat sections have been especially designed for receiving the longitudinally directed hose sections. With such a design of the air bubble mat, each new bubble pattern requires new mat sections which can only be made with expensive tools. Furthermore, the assembly effort for such an air bubble mat is comparatively great, because the hose sections first must be provided with air outlets and then must be threaded into all the mat sections.

SUMMARY OF THE INVENTION

It is an object of the invention to provide an air bubble mat of the type described above, where the single mat section or the individual mat sections can be simplified and used for a plurality of bubble patterns and can be assembled with considerably less effort.

This object is attained according to the invention where the single mat section or the individual mat sections merely comprise a support element which has in its receptacle a one-piece or multi-piece foil mat, where the sections of the foil mat are each assembled from two foils placed on top of one another between which the air feed ducts or air chambers have been defined by welding or other connections outside of the air feed ducts or air chambers, where the air feed ducts or air chambers of the sections of the foil mat are connected with each other and/or with the connecting stub and where the air outlets are inserted in the foils of the section of the foil mat facing the underside of the support element.

The single mat section or the individual mat sections are only used as support elements so that in using the air bubble mat the user does not lie on the sections of the foil mat, does not deform them and does not block any air feed ducts and air outlets. The sections of the foil mat can be simply and quickly manufactured from two foils, where by welding or other connections alone it is possible to change the bubble pattern by means of a changed distribution of the air feed ducts and disposition of air chambers. These different foil mats are then buttoned or otherwise fastened as a complete unit into the support element comprised of the single mat section or the individual mat sections. If the individual foil mat or a portion thereof has been damaged or destroyed, it can easily be exchanged or replaced by a new air bubble mat or a new section, even, if desired, with a new bubble pattern. The single mat section or the individual mat sections are considerably simpler, because they no longer require receptacles for threading in hose sections. Thus the air bubble mat can be manufactured considerably cheaper.

According to a preferred embodiment of this invention, the single mat section or the individual mat sections are made in the form of panels and are provided, on the sides extending in the longitudinal direction of the air bubble mat and in the area of the receptacle, with support fins formed from the mat and extending approximately vertically to the underside.

It is also possible to produce the single mat section or the individual mat sections by deep drawing from plastic.

If the single mat section or the individual mat sections are provided with support pins with enlarged heads formed on the underside, on which the sections of the foil mat provided with openings are buttoned or can be buttoned, it is possible to produce the single mat section or individual mat sections as injection molded parts from plastic. By a suitable distribution of the openings in the sections of the foil mat it is possible to connect the individual mat sections at a distance from each other with the sections of the foil mat, so that the section of the foil mat between the individual mat sections acts as a hinge and allows the air bubble mat to be folded.

So that the sections of the foil mat are protectively disposed in the air bubble mat, in accordance with a further embodiment, the open undersides of the single mat section or individual mat sections are closed or can be closed by means of cover panels or strips after the sections of the foil mat have been inserted.

A simple bubble pattern with longitudinally oriented rows of air outlets is provided where the single mat section or individual mat sections have rows of openings extending in the longitudinal direction and where the air feed ducts are correspondingly distributed and longitudinally extend on the sections of the foil mat. The structural design in this case preferably is such that the individual mat sections disposed on the ends of the support element are rounded on their free ends or that the single mat section is rounded on both ends, that the air feed ducts on a rounded end of the section of the foil mats connect to a connecting stub inserted into the foil facing the support element which, after the sections of the foil mat have been connected with the support element, extends through a bore in the facing individual mat section or the facing end area of the single mat section of the support element, and that the rows of openings in the facing individual mat element or the facing end area of the single mat section follow the course of the air feed channels to the connecting stub.

A pressure build-up in the air feed ducts is assured in that the air feed ducts are closed on the end opposite the end having the connecting stub.

In accordance with a further embodiment, a grid-like bubble pattern results where the openings in the single mat section or individual mat sections are disposed in longitudinally and crosswise extending rows, where correspondingly the sections of the foil mat are divided in the longitudinal direction into a plurality of air feed grids, where these air feed grids are connected through feed ducts with a separate compressed air distributor which is connected with the support element and where through the compressed air distributor the air feed grids can be connected individually and/or in combination with the connecting stub of the compressed air distributor. In this manner, the air feed grids can be optionally controlled.

If the individual mat sections are connected with each other and with the compressed air distributor by means of hinges, the support element can be prefabricated and equipped with any foil mat, which is only required to be adapted in its size to the receptacle in the underside of the support element.

In connection with straight air feed ducts, the air outlets are set in the two rim areas of the air feed ducts or of the longitudinally and crosswise extending air feed ducts of the air feed grids, so that the air bubbles exiting the air outlets are not contained in the central area of the air feed duct being located at the shortest distance from the opening, which perhaps might be covered by the user, if it is intended to keep the structural height of the air bubble mat low.

The single mat section or individual mat sections can also be adjusted to the air feed ducts in such a way that the openings in the single mat section or individual mat sections are in the form of longitudinally extending slits which taper towards the underside or are reduced in width, and that the air feed ducts in the area of these slits are provided with a row of air outlets. In this case the air bubbles exiting the air outlets directly reach the slit and are guided through it. It is possible to keep the slits narrow enough, so that they are assuredly covered by the body of the user.

Rubber or plastic foils are preferably used for manufacturing the foil mat.

The invention will be explained in detail by means of exemplary embodiments shown in the drawings.

DETAILED DESCRIPTION OF PREFERRED EMBODIMENTS

Figure 1:
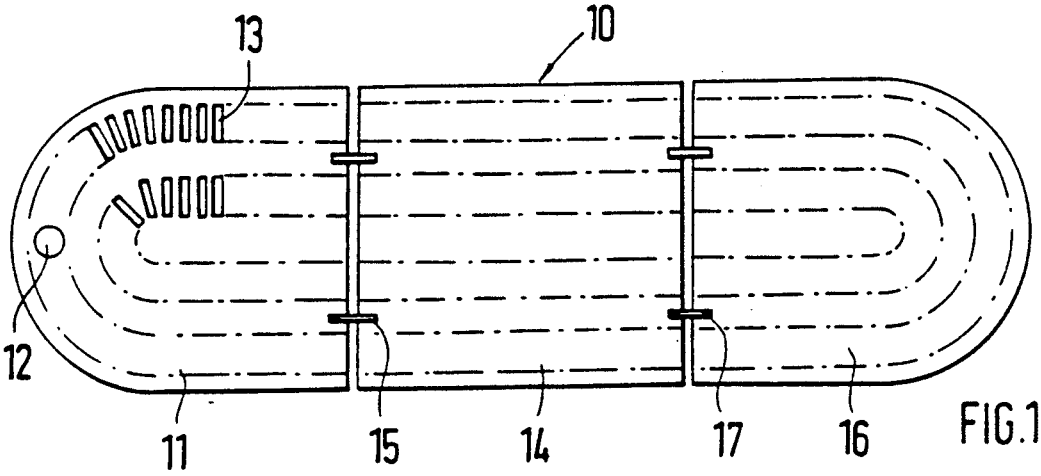
FIG. 1 is a top view of a support element formed of three mat sections.
Figure 2:
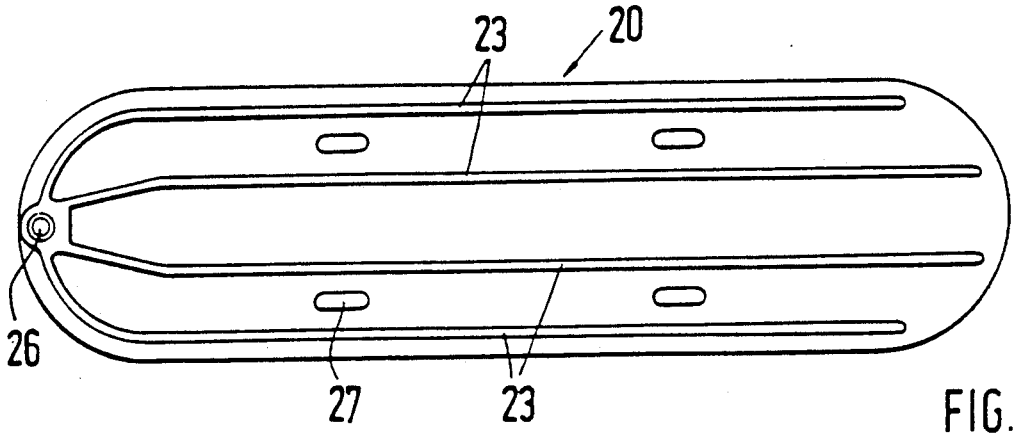
FIG. 2 is a top view of a foil mat which can be inserted into the receptacle on the underside of the support element in accordance with FIG. 1.
Figure 3:
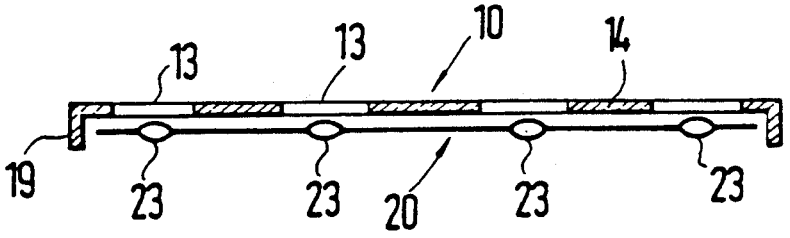
FIG. 3 is a schematic cross section of the air bubble mat with the support element in accordance with FIG. 1 and the foil mat in accordance with FIG. 2.
Figure 4:
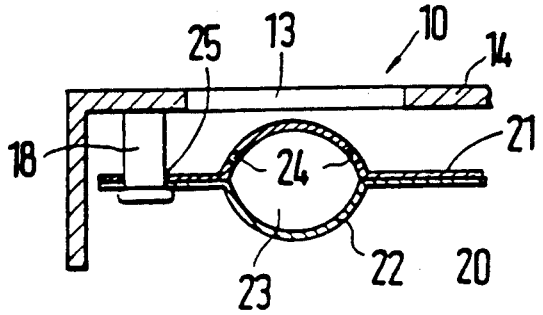
FIG. 4 is an enlarged partial section showing a mode of fastening between a mat section and the foil mat.

In the exemplary embodiment shown in FIGS. 1 to 4, the support element 10 consists of three mat sections 11, 14 and 16. In this case, hinges 15 connect the mat sections 11 and 14 and hinges 17 connect the mat sections 14 and 16. The free ends of the mat sections 11 and 16, disposed on the ends of the support element 10, are rounded off in a semicircular manner. Four rows of rectangular openings 13 are arranged in the mat sections, which are connected in a semicircular manner to each other in pairs and concentric to each other in the mat sections 11 and 16, thus forming an inner and an outer loop. The mat sections 11, 14 and 16 are provided on their longitudinally directed outer rims, and the support section 11 and 16 on their end rims, with the support fin 19, by means of which they are supported on the floor of the bathtub when the air bubble mat has been placed into it. As the section in FIG. 3 shows, the support element 10 forms a receptacle over its entire length which is open towards the underside of the support element 10.

The foil mat shown in FIG. 2, which in its shape and dimensions is adapted to the shape and dimensions of the receptacle of the support element 10, is inserted into this receptacle. The foil mat 20 consists of two foils 21 and 22 placed on top of each other, between which the air feed ducts 23 are defined by welding o other connection. The air outlets 24 are disposed in the edge area of the air feed ducts 23 in the foil 21 facing the underside of the mat sections 11, 14 and 16. Because the air feed ducts 23 follow the course of the rows of openings 13 in the mat section 11, 14 and 16, the air outlets 24 are aligned beneath openings 13, so that the exiting air bubbles can reach the body of the user, lying on the support element 10, without hindrance through the openings 13 of the support element 10. The foil mat 20 is not weighted down and the air feed ducts 23 can expand in the way shown in FIG. 4., when the compressed air is admitted. The foil mat 20 is simply buttoned into the receptacle of the support element 10. For this purpose support pins 18 with enlarged heads, for example, are formed on the underside of the mat sections 11, 14 and 16 and the foil mat 20 has correspondingly distributed holes 25. Because the foil mat 20 preferably has foils 21 and 22 of rubber, it has sufficient elasticity so that it can be buttoned on these support pins 18.

The air feed ducts 23 merge in a connecting stub 26, which has been inserted into the foil 21. After insertion of the foil mat 20 into the support element 10, this connecting stub 26 extends out of the bore 12 of the mat section 11 and can receive the air hose feeding the compressed air from the blower to the air bubble mat.

Figure 5:
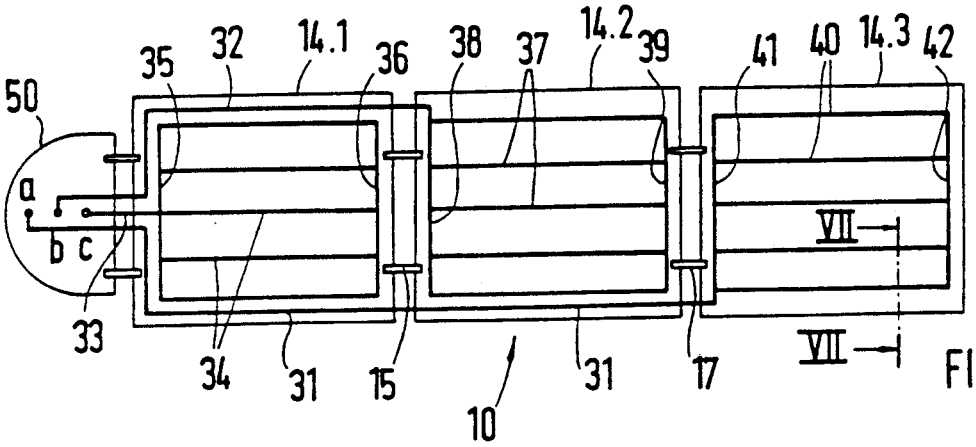
FIG. 5 is a schematic bottom view of another bubble mat with three mat sections and a compressed air distributor and a foil mat distributed in the air feed grid.
Figure 6:
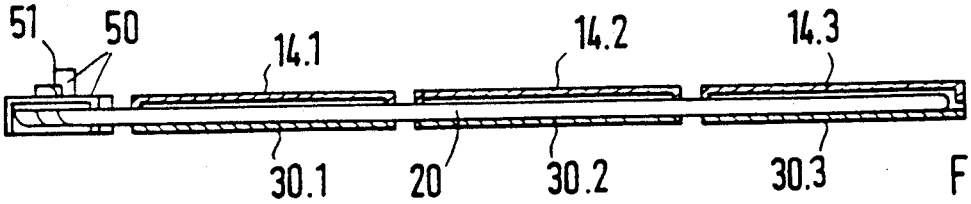
FIG. 6 is a longitudinal section of the air bubble mat in accordance with FIG. 5.
Figure 7:
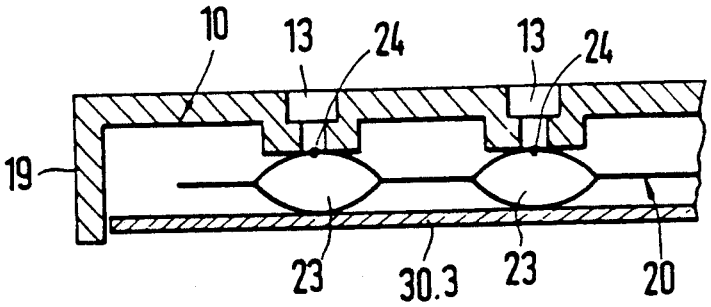
FIG. 7 is an enlarged partial view showing a mat section, the foil mat and the cover plate.

FIGS. 5 to 7 show another exemplary embodiment of an air bubble mat in accordance with the invention. Three identical rectangular mat sections 14.1, 14.2 and 14.3 form the support element 10 in the longitudinal direction. Connection of these mat sections is provided by the hinges 15 and 17. A compressed air distributor 50 is hinged on one end to the support section 10, which contains the control valve 51, and is provided with the connecting stub for the air hose.

As schematically shown in FIG. 5, the foil mat 20 has three sections disposed as air feed grids, as shown by the longitudinally and crosswise extending air feed ducts 34, 35, 36 or 37, 38, 39 or 40, 41, 42. The compressed air distributor 50 contains a control valve 51, having three control positions a, b and c. In control position a, the connecting stub is connected through the control valve 51 and the feed duct 31 to the air feed grid disposed in the area of the mat section 14.3. The feed duct 31 runs on an outer rim of the foil mat 20 along the air feed ducts assigned to the mat sections 14.1 and 14.2. Thus, when compressed air is fed in, air bubbles exit the foil mat 20 only in the area of the mat section 14.3. In control position b, compressed air is fed through the feed duct 32 only to the air feed grid underneath the mat section 14.2, and in the control position c through the feed duct 33 only to the air feed grid underneath the mat section 14.1. However, the control valve 51 can also be designed such that in control position a the air feed grid underneath the mat section 14.3 is provided with compressed air and bubbles, in control position b the air feed grids underneath the mat sections 14.2 and 14.3 are provided with compressed air and bubble and, finally, in control position c all air feed grids underneath all mat sections 14.1, 14.2 and 14.3 are provided with compressed air and bubble.

As shown in the section in accordance with FIG. 6, after the foil mat 20 has been inserted into the receptacle of the support element 10, the mat sections 14.1, 14.2 and 14.3 are closed off with cover plates 30.1, 30.2 and 30.3, so that the foil mat 20 is protectively housed in the support element 10.

As shown by the partial section in accordance with FIG. 7, the mat sections may also have openings 13 in the form of longitudinal and/or crosswise slits, which are very narrow and further taper in the direction of the foil mat 20 or are set off in their width. The slits are oriented towards the center of the air feed ducts 23, so that the air outlets 24 cut out there extend congruently with the slits.

The openings 13 in the mat sections can be disposed in the shape of a grid, so that the air feed ducts 23 can extend in any manner in the foil mat 20. The air outlets 24 of the foil mat 20 ca then be correspondingly distributed, but the division of the foil mat 20 into bubble areas can also be provided in a different way. The foil mat 20 may also have bubble areas distributed over the width of the air bubble mat.

This construction of an air bubble mat from a support element 10 and a foil mat 20 results in components which are easy to manufacture and to pre-assemble, so that they only need to be connected with each other in a simple manner. It is also easy to replace the foil mat.

I claim:

1. In an air bubble mat for an air bubble massage device having a mat section extending over a length of said air bubble mat and a width of said air bubble mat and provided with openings, where the mat section forms a receptacle on an underside of said mat section for receiving air feed ducts, where the air feed ducts are provided with air outlets corresponding to the openings of the mat section and are connected to one of a connecting stub and a compressed air distributor connecting stub, the improvement comprising:

said mat section comprising a support element (10) having in said receptacle an interchangeable foil mat (20), said interchangeable foil mat (20) being assembled from two foils (21, 22) placed on top of one another, having said air feed ducts (23) defined by connecting means outside of said air feed ducts (23), said air feed ducts (23) of said interchangeable foil mat (20) being connected with each other and with said connecting stub (26), said air outlets (24) being inserted in said foil (21) of said interchangeable foil mat (20) facing the underside of said support element (10) and forming an air bubble pattern, said air bubble pattern being changeable by changing said interchangeable foil mat (20), and said mat section forming a panel having sides extending in a longitudinal direction of said air bubble mat and forming support fins (19) from said mat which extend approximately vertically to said underside in an area of said receptacle into which said interchangeable foil mat (20) is inserted.

2. An air bubble mat in accordance with claim 1, wherein said mat section has support pins (18) with enlarged heads formed on said underside inserted through holes (25) in said interchangeable foil mat (20).

3. An air bubble mat in accordance with claim 2, wherein said mat section further comprises cover panels (30.1, 30.2, 30.3) enclosing said underside of said mat section with said interchangeable foil mat (20) inserted in said receptacle.

4. An air bubble mat in accordance with claim 3, wherein said mat section has rows of said openings (13), said rows extending in a longitudinal direction of said mat section and said air feed ducts (23) are distributed correspondingly to said rows of said openings (13) extending longitudinally on said interchangeable foil mat (20).

5. An air bubble mat in accordance with claim 4, wherein said mat section is rounded on a first end and a second end of said support element (10), said air feed ducts (23) on a rounded said first end of said interchangeable foil mat (20) merge into said connecting stub (26) inserted into said foil (21) facing said support element (10) which, where said foil mat (20) is connected with said support element (10), extends through a bore (12) in said mat section of said support element (10).

6. An air bubble mat in accordance with claim 5, wherein said air feed ducts (23) are sealed on said second end of said mat section opposite said first end of said mat section having said connecting stub (26).

7. An air bubble mat in accordance with claim 3, wherein said openings (13) in said mat section are disposed in longitudinally and crosswise extending rows, said interchangeable foil mat (20) is correspondingly divided into a plurality of air feed grids, said air feed grids are connected through feed ducts (31, 32) to one of a compressed air distributor (50) which is connected to said support element (10) and said compressed air distributor connecting stub (51).

8. An air bubble mat in accordance with claim 7, wherein said mat section is connected to at least one other mat section (11, 14, 16; 14.1, 14.2, 14.3) and to a compressed air distributor (50) by hinges (15, 17).

9. An air bubble mat in accordance with claim 8, wherein said air outlets (24) are positioned in one of longitudinally and crosswise extending air feed ducts (34, 35, 36; 37, 38, 39; 40, 41, 42) of said air feed grids and two rim areas of said air feed ducts (23).

10. An air bubble mat in accordance with claim 8, wherein said openings (13) in at least one of said mat section and each said other mat section form longitudinally extending slits being one of tapered towards said underside are reduced in width, and said air feed ducts (23) have a row of air outlets (24) corresponding to said slits.

11. An air bubble mat in accordance with claim 10, wherein said mat section is plastic formed by one of injection molding and deep drawing.

12. An air bubble mat in accordance with claim 11, wherein said interchangeable foil mat (20) is made of one of two rubber foils and two plastic foils.

13. An air bubble mat according to claim 1, wherein said mat section has support pins (18) with enlarged heads formed on said underside inserted through holes (25) in said interchangeable foil mat (20).

14. An air bubble mat according to claim 1, wherein said mat section further comprises cover panels (30.1, 30.2, 30.3) enclosing said underside of said mat section with said interchangeable foil mat (20) inserted in said receptacle.

15. An air bubble mat according to claim 1, wherein said mat section has rows of said openings (13), said rows extending in a longitudinal direction of said mat section and said air feed ducts (23) are distributed correspondingly to said rows of said openings (13), extending longitudinally on said interchangeable foil mat (20).

16. An air bubble mat according to claim 1, wherein said mat section is rounded on a first end and a second end of said support element (10), said air feed duct (23) on a rounded said first end of interchangeable foil mat (20) merge into said connecting stub (26) inserted into said foil (21) facing said support element (10) which, where said foil mat (20) is connected with said support element (10), extends through a bore (12) in said mat section of said support element (10), and rows of said openings (13) in said mat section are distributed corresponding to said air feed ducts (23) connecting to said connecting stub (26).

17. An air bubble mat according to claim 1, wherein said air feed ducts (23) are sealed on a second end of said mat section opposite a first end of said mat section having said connecting stub (26).

18. An air bubble mat according to claim 1, wherein said openings (13) in said mat section are disposed in longitudinally and crosswise extending rows, said interchangeable foil mat (20) is correspondingly divided into a plurality of air feed grids, said air feed grids are connected through feed ducts (31, 32) to one of a compressed air distributor (50) which is connected to said support element (10) and said compressed air distributor connecting stub (51).

19. An air bubble mat according to claim 1, wherein said mat section is connected to at least one other mat section (11, 14, 16; 14.1, 14.2, 14.3) and to a compressed air distributor (50) by hinges (15, 17).

20. An air bubble mat according to claim 1, wherein said air outlets (24) are positioned in one of longitudinally and crosswise extending air feed ducts (34, 35, 36; 37, 38, 39; 40, 41, 42) of air feed grids and two rim areas of said air feed ducts (23).

21. An air bubble mat according to claim 1, wherein said openings (13) in said mat section form longitudinally extending slits being one of tapered towards said underside and reduced in width, and said air feed ducts (23) have a row of said air outlets (24) corresponding to said slits.

22. An air bubble mat according to claim 1, wherein said mat section is plastic formed by one of injection molding and deep drawing.

23. An air bubble mat according to claim 1, wherein said interchangeable foil mat (20) is made of one of two rubber foils and two plastic foils.

* * * * *